US006691439B1

(12) United States Patent
Miyashita et al.

(10) Patent No.: US 6,691,439 B1
(45) Date of Patent: Feb. 17, 2004

(54) FULL-SHRINK LABELED CONTAINER AND TUBULAR SHRINK LABEL

(75) Inventors: Takashi Miyashita, Tokyo (JP); Takeshi Haraya, Tokyo (JP); Kazunori Kunitake, Tokyo (JP); Kazuo Okada, Tokyo (JP); Eiji Sawa, Tokyo (JP); Makoto Fukuhara, Osaka (JP); Tetsuo Hata, Osaka (JP)

(73) Assignees: Asahi Breweries, Ltd., Tokyo (JP); Fuji Seal, Inc., Osaka (JP)

( * ) Notice: Subject to any disclaimer, the term of this patent is extended or adjusted under 35 U.S.C. 154(b) by 0 days.

(21) Appl. No.: 09/647,831

(22) PCT Filed: Apr. 8, 1999

(86) PCT No.: PCT/JP99/01870

§ 371 (c)(1),
(2), (4) Date: Oct. 5, 2000

(87) PCT Pub. No.: WO99/52788

PCT Pub. Date: Oct. 21, 1999

(30) Foreign Application Priority Data

Sep. 4, 1998 (JP) ..... 10-97904

(51) Int. Cl.[7] ..... G09F 3/00
(52) U.S. Cl. ..... 40/310
(58) Field of Search ..... 40/310, 306; 283/81

(56) References Cited

U.S. PATENT DOCUMENTS

| | | | | | |
|---|---|---|---|---|---|
| 3,733,002 | A | * | 5/1973 | Fujio | 40/310 |
| 3,750,317 | A | * | 8/1973 | Morgan | 283/81 |
| 5,605,230 | A | * | 2/1997 | Marino et al. | 40/310 |
| 5,924,739 | A | * | 7/1999 | Garbutt | 283/81 |
| 6,231,958 | B1 | * | 5/2001 | Kim et al. | 528/272 |
| 6,385,878 | B1 | * | 5/2002 | Key | 40/306 |

* cited by examiner

*Primary Examiner*—Gary Hoge
(74) *Attorney, Agent, or Firm*—Jordan and Hamburg LLP

(57) ABSTRACT

A full-shrink labeled container has an opening sealed with a plug provided with a pull-up part for unsealing, a body to which a shrink label having a heat shrinkability is applied, and a neck having the circumference shorter than that of the body. The shrink label covers the container from the lower end part to the upper end part, also the pull-up part, and is formed with tear-off means capable of exposing the pull-up part.

22 Claims, 11 Drawing Sheets

FULL-SHRINK LABELED CONTAINER AND TUBULAR SHRINK LABEL

FIELD OF THE INVENTION

This invention relates to a full-shrink labeled container with a shrink label applied to a body of a container such as a glass bottle and plastic bottle, as well as a tubular shrink label, and more particularly a tubular shrink label having a high shrinkability and a full-shrink labeled container with the tubular shrink label applied thereto.

BACKGROUND OF THE INVENTION

Conventionally known containers of this type include a glass bottle for soft drink beverages and the like whose body has a shrink label applied thereto. The body of the glass bottle is covered with a shrink label with pre-applied designs, printed representations, etc., thereto.

The labeled container of the above conventional type has a neck positioned above the body, having a diameter smaller than the body and being tapered down to the tip. The neck is, however, not covered with the shrink label and therefore exposed. This leads to lacking the sense of unity in appearance of the glass bottle and the shrink label, and particularly for a brown bottle filled with beer or the like, the problem of lacking the sense of unity in appearance is obvious, since the brown surface is exposed.

Recently used as a stopper for sealing an opening of the container in place of a conventional cap, screw cap and the like is a breakable cap for easy open having excellent opening and sealing abilities. The breakable cap for easy open is formed with a pull ring extending downwardly to act as a pulling part for unsealing, so that the opening of the bottle can be unsealed by breaking the breakable cap away from the opening of the bottle through pull-up action effected by a finger inserted into the pull ring and application of the pull-up action thereto.

The container however poses a problem that the pull ring tends to be caught by something, causing deformation or damage of itself during distribution, handling, etc., of the container.

The conventional container thus poses various problems due to the exposure of the neck, the pull ring, etc., with the shrink label applied only to the body. On the other hand, for the container with the greatly smaller neck such as having a diameter about ⅓ times the diameter of the body, the shrink label is required to have a high shrinkability effected only in the peripheral direction. Therefore, it is difficult to cover the container, even to the neck, with a single shrink film sheet to obtain a united appearance, and also difficult to manufacture the container having such a united appearance at a relatively low cost and in large quantities.

In consideration of the above conventional problems, it is an object of the present invention to achieve an improved appearance of the container and prevent the deformation, damages, etc., of the cap during the distribution, etc., by unitedly covering the container from the body to the neck with a single shrink label.

SUMMARY OF THE INVENTION

The full-shrink labeled container of the present invention has been conceived to solve the above problems, and has an opening scaled with a plug provided with a pull-up part for unsealing, a body to which a shrink label having a heat shrinkability is applied, and a neck having the circumference shorter than that of the body. The container is characterized by that the shrink label covers the container from the lower end part to the upper end part and also the pull-up part, and is formed with tear-off means capable of exposing the pull-up part.

The full-shrink labeled container has the pull-up part covered with the shrink label so as not to be exposed, thereby eliminating the possibility that the pull-up part is caught by something during the distribution. In addition, the shrink label unitedly covers the container, even to the neck, thereby preventing the surface of the container from being exposed.

Moreover, the opening of the container can be unsealed by tearing off the label through the tear-off means to expose the pull-up part of the cap, and then pulling the exposed pull-up part upwardly to remove the plug from the opening of the container.

A tubular shrink label according to the present invention is characterized by that it is formed by a polyester film having a heat shrinkability whose shrinkage percentage after the elapse of five seconds in hot water of 85° C. is 73% or more in the circumferential direction of the shrink label.

Whereby, the tubular shrink label, which has been fitted around the container with the body and the neck having a diameter smaller than the body, and then heat shrunk, can securely cover the container, even to the neck.

DETAILED DESCRIPTION OF THE PREFERRED EMBODIMENTS

Figure 1A:
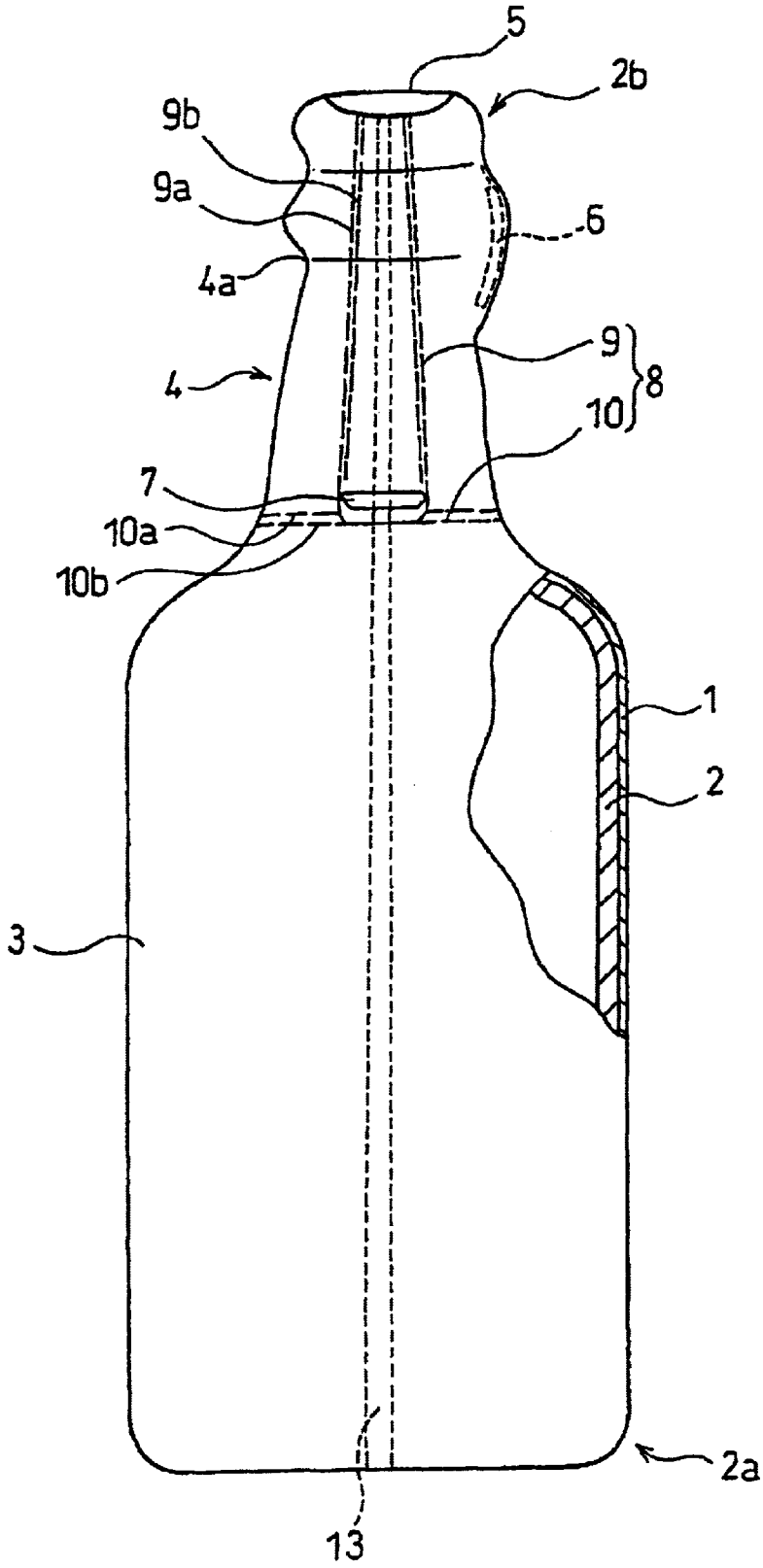
FIG. 1(*a*)and FIG. 1(*b*) are front views with a partial cross section illustrating a full-shrink labeled container according to a first embodiment of the present invention.

The embodiments of the full-shrink labeled container according to the present invention will hereinafter be described with reference to the drawings attached hereto, in which corresponding or identical parts to those among the respective embodiments have been given the same reference characters to omit a detailed description thereof.

First Embodiment

Figure 1B:
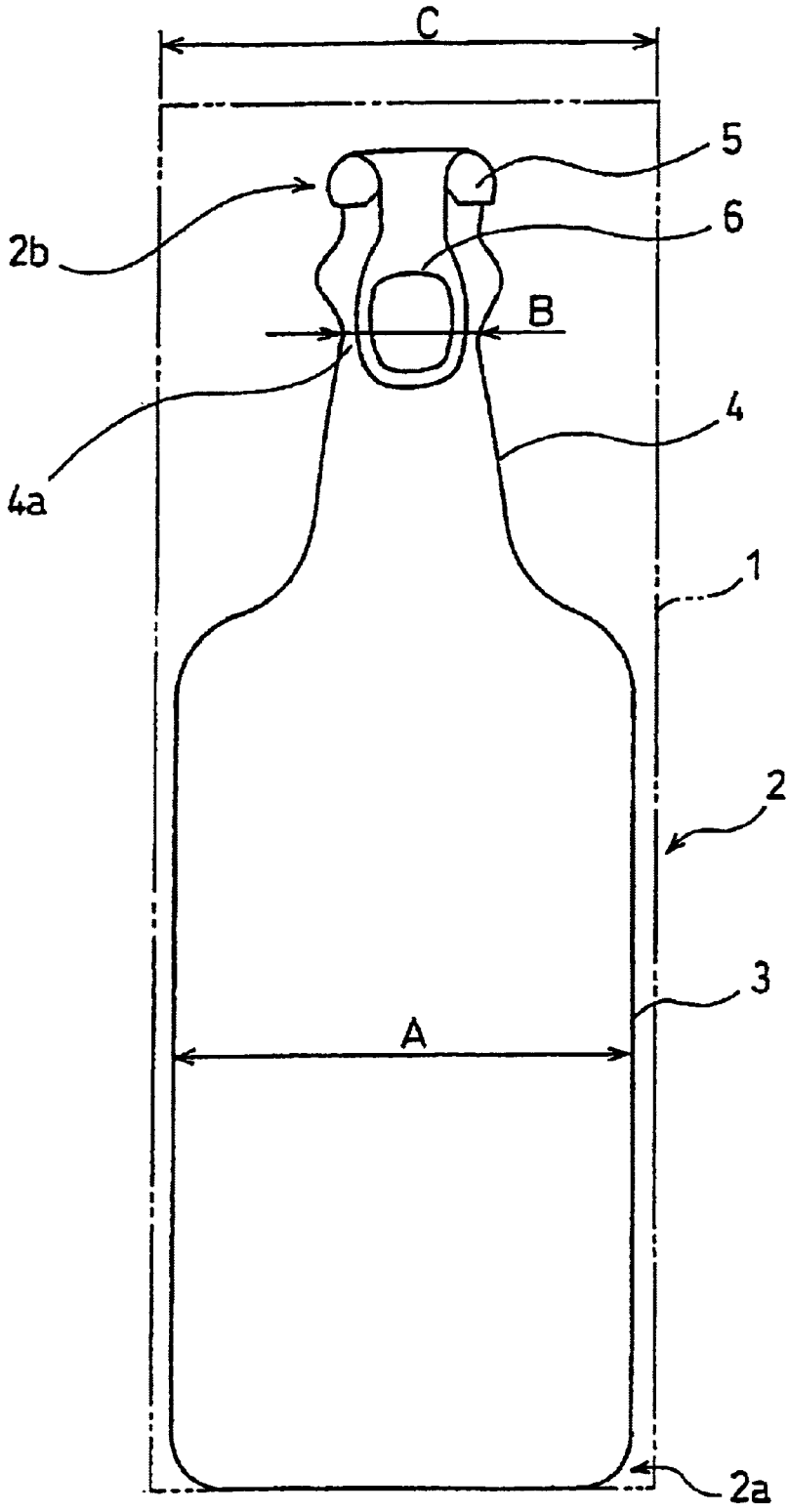

As illustrated in FIG. 1(*a*) and FIG. 1(*b*), the full-shrink-labeled container of this embodiment is a brown-colored glass bottle 2 with a heat-shrinkable shrink label 1 having a tubular shape applied thereto. The shrink label 1 used in this embodiment is formed by a heat-shrinkable polyester film such as polyethylene terephthalate and polyester copolymer having a thickness of 10 to 100 $\mu$m (more preferably 30 to 80 $\mu$m). The film has a print side with characters, designs, etc., printed thereon, and opposite lateral edges overlapping one another with the print side facing inwardly, and the overlapping part (not shown) bonded together to have a tubular shape.

The tubular shrink label 1 has a shrinkage percentage of not less than 75% in the circumferential direction when immersed in hot water of 85° C. for 5 seconds.

On the other hand, the glass bottle 2 to which the shrink label 1 is applied forms at its lower side a body 3 having a substantially uniform diameter A, and a neck 4 positioned above the body 3 as having a diameter smaller than the same. The neck 4 is tapered down to the tip with a diameter gradually decreased towards the opening part positioned above, and has a smallest part 4*a*, which is the most thinner part in the bottle, having a diameter B which is 37% the diameter A of the body 3. The diameter C of the shrink label 1 prior to the shrinkage is between 103 to 110% of the diameter A of the body 3.

The opening part opened to above the glass bottle 2 is sealed by a breakable cap for easy open, which is sold, for example, under the tradename of Maxi-P cap, etc., by Japan Crown Cork Co., Ltd., as a plug having a pull ring 6 (pull-up part). The pull ring 6 is formed into a ring for receiving a finger of the user and is provided as extending downwardly towards the neck 4.

Figure 2:
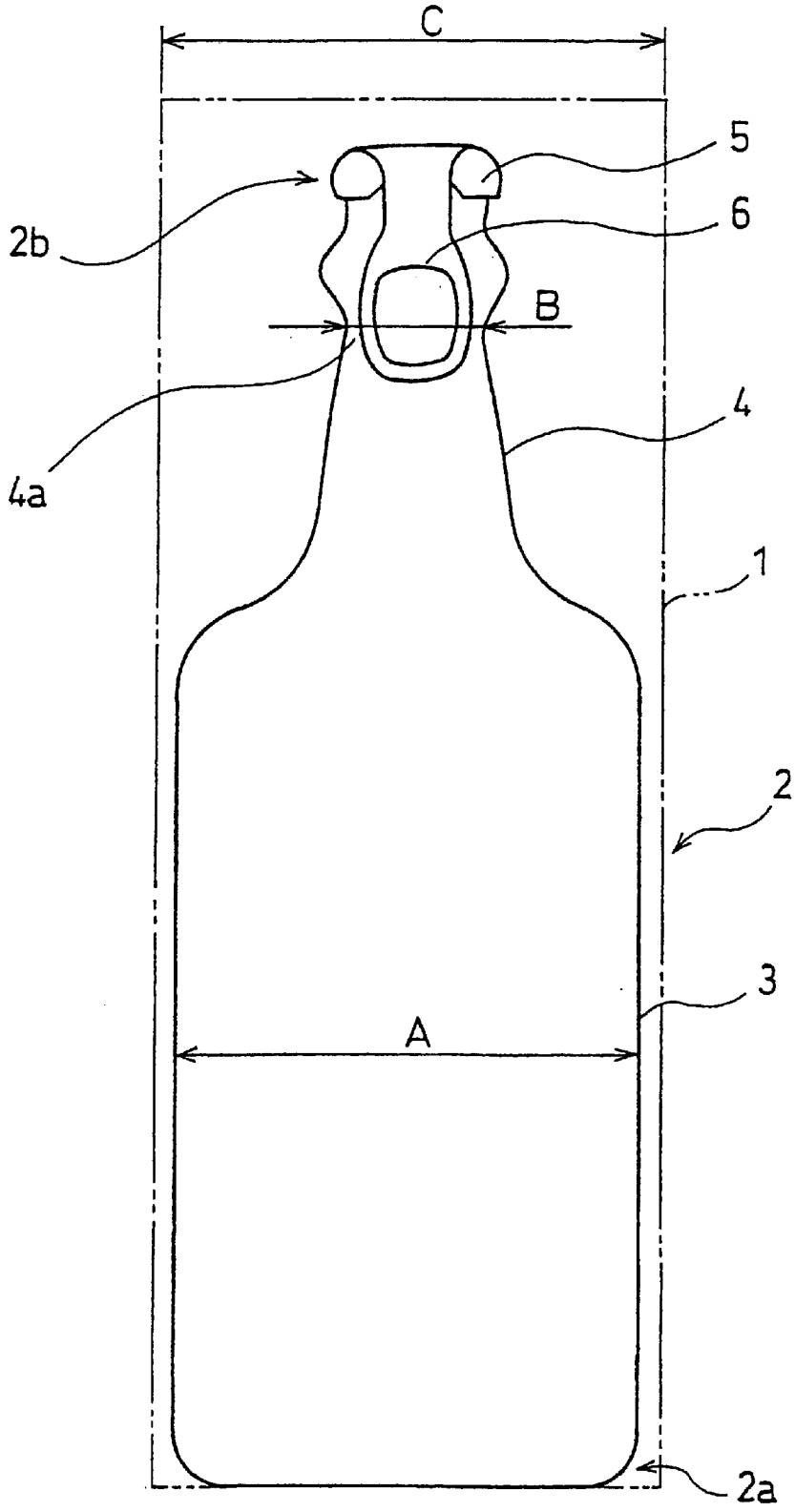
FIG. 2 is a front view illustrating the container of FIG. 1 with a label applied thereto.

The shrink label 1 formed into a tube as illustrated in double-dashed broken line in FIG. 2 is applied around the glass bottle 2 and subjected to a heating treatment to cover the glass bottle 2 from a lower end part 2*a* to an upper end part 2*b*. The breakable cap for easy open 5 also has an upper outer circumferential edge and the pull ring 6, both covered with the shrink label 1. That is, the shrink label 1 does not cover only the entirety of the circumference of the glass bottle 2, but also the pull ring 6.

Figure 3:
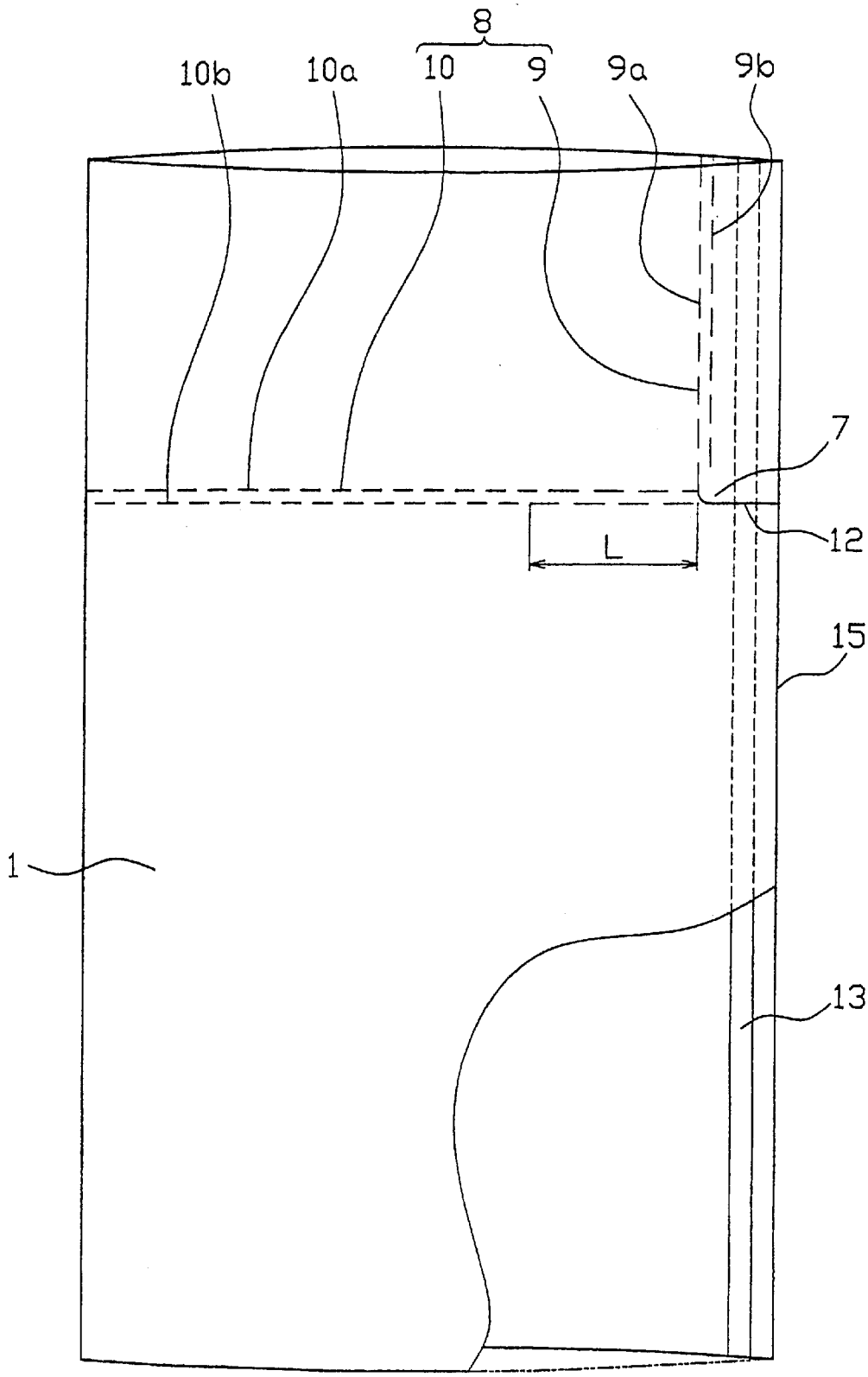
FIG. 3 is a side view with a broken away portion illustrating a shrink label to be used for the container of FIG. 1, as having a flat shape prior to the shrinkage.
Figure 4:
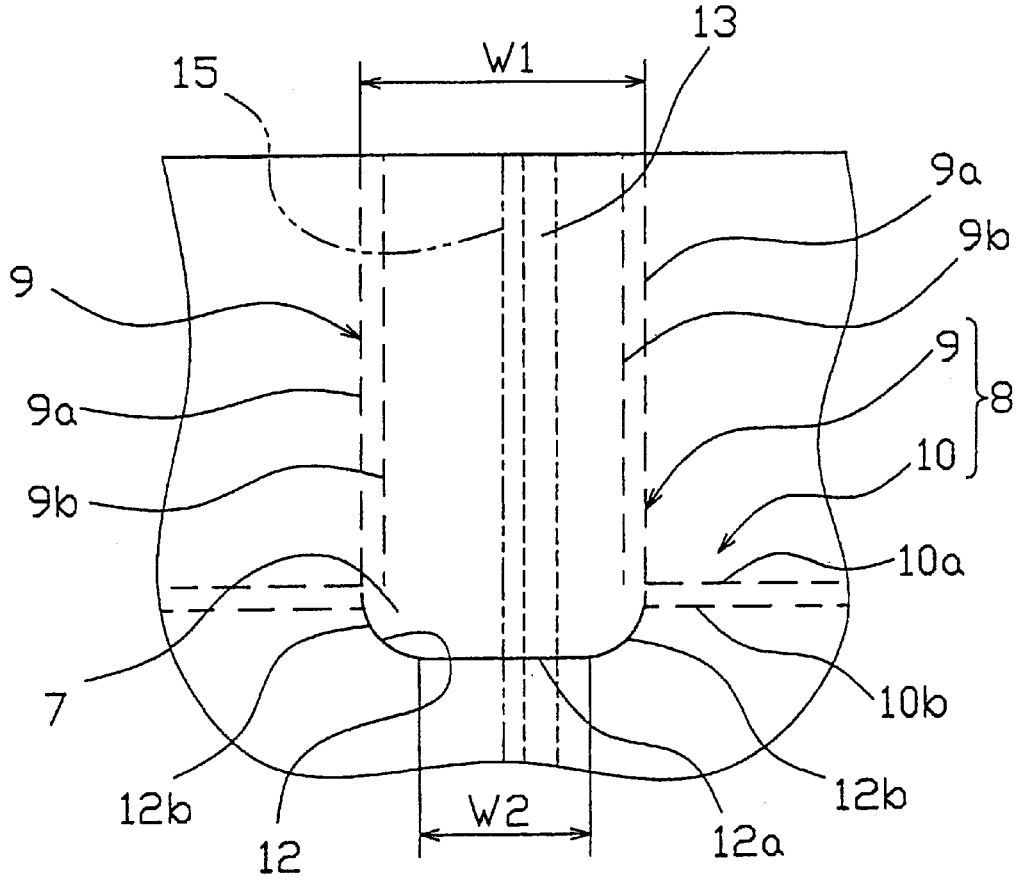
FIG. 4 is a front view illustrating an essential portion of the shrink label of FIG. 3 prior to the shrinkage.

The shrink label 1 is, as illustrated in FIGS. 3 and 4, provided with a pull tab 7 (tear starting part) provided by forming a cut 12 in the label for the unsealing of the label, and which is disposed above a shoulder (base of the neck) which is located below the neck of the container, and below the pull ring 6 when the shrink label is applied to the container. Perforations 8 are formed as tear-off means for exposing the pull ring 6 with the pull tab 7 as a starting point for the tearing-off. Accordingly, the pull tab 7 lies at the neck 4, a thin part of the container, thereby preventing, as far as possible, the cut 12 from being expanded through the shrinkage of the shrink label, and hence the light from intruding through the cut 12.

The pull tab 7 is a non-print, part of the label which has not been subjected to printing. The reason why the pull tab 7 is the non-print part is that, when the label 1 has been heat-shrunk, the non-print part is less affected, as compared with the residual part (part with a printed layer), by the printed layer which becomes thicker through heat shrinkage, enabling the pull tab 7 to maintain original softness and stretchability of the film. The non-print part does not carry particularly a white printed layer having hard ink coating, thereby avoiding the hardening of the pull tab 7, and hence allowing the pull tab 7 to maintain a tactile sensation of feeling soft.

The perforations 8 include a pair of vertical perforated portions 9 acting as vertical tear-off means with the pull tab 7 as a starting point for the tearing-off to unseal the label 1 from the lower side to the upper side, and horizontal perforated portion 10 formed in the circumferential direction of the glass bottle 2 to act as horizontal tear-off means with the pull tab 7 as a starting point for the tearing-off.

The pair of vertical perforated portions 9 extend from the vicinity of the shoulder of the glass bottle 2 to the vicinity of the upper end, reaching or nearly reaching plug 5, of the shrink label 1 in such a manner as to become closer to one another towards the above. By "forming to the vicinity of the upper end of the shrink label 1", it is meant that the vertical perforated portions do not extend to the upper edge of the shrink label 1.

In the above regard, the pair of vertical perforated portions 9 are, as illustrated in FIG. 4, formed parallel to one another prior to the shrinkage of the label, while the cut 12 includes a central straight part 12*a* and opposite curved parts 12*a*, in which the width W2 of the straight part has a ratio of 0 to 80% (preferably 30 to 60%) with respect to the entire width W1 of the cut 12.

The reason why the width W2 of the straight part is designed in flat is to prevent the pull tab from being rugged, and hence enhance a soft tactile sensation in cooperation with the pull tab formed in the non-print part.

The reason why the pair of vertical perforated portions 9 do not extend to the upper end edge of the shrink label 1 is that, when the cap 5 has the upper peripheral edge covered with the upper end part of the shrink label 1, the label between the pair of perforated portions is unlikely to rise and turn into protrusions, thereby avoiding an uncomfortable feeling of a prickly sensation when touching them by a hand.

Figure 5:
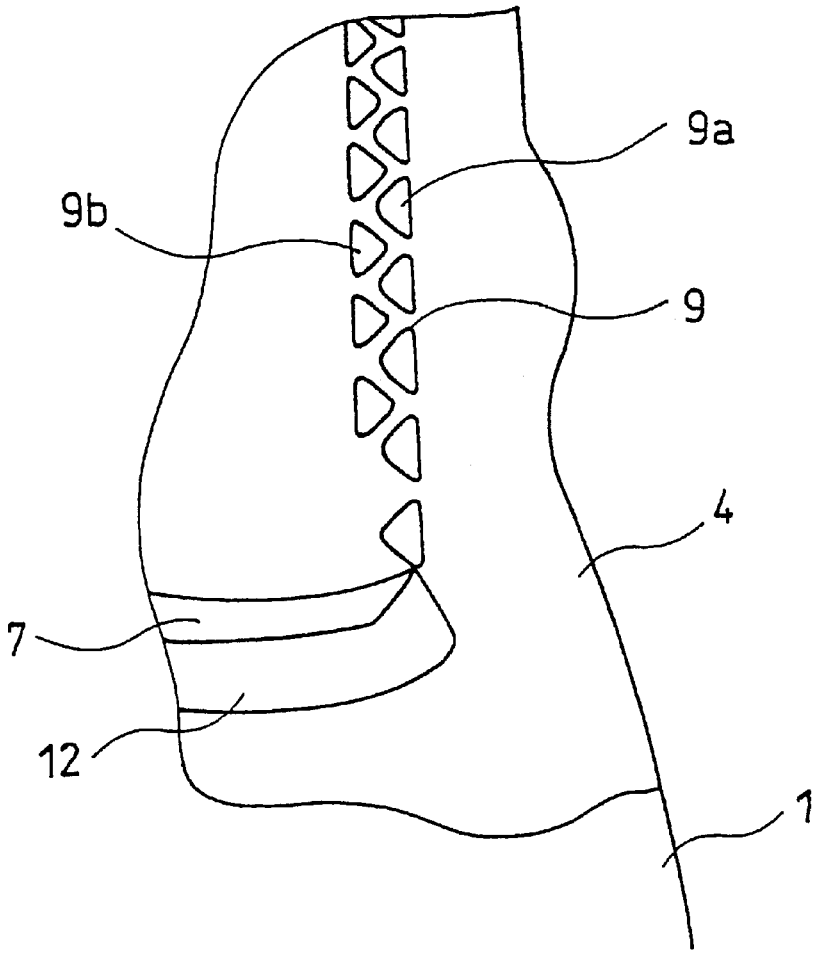
FIG. 5 is a front view illustrating an essential portion of the full-shrink labeled container of FIG. 1(*a*) and FIG. 1(*b*).

Each of the pair of vertical perforated portions 9 and the horizontal perforated portion 10 are respectively formed in plural lines (two lines in this embodiment). Specifically, the pair of vertical perforated portions 9 each have a main-vertical perforation line (outer vertical perforation line) 9*a* and a sub-vertical perforation line (inner vertical perforation line) 9*b*, both of which are formed closer to and parallel to one another. The outer vertical perforation lines 9*a* are respectively connected to the curved parts 12*b* of the cut 12, while the inner vertical perforation lines 9*b* are not respectively connected to the curved parts 12*b*. The corresponding inner and outer vertical perforation lines 9*b* and 9*a* each have perforations alternately positioned such that the perforations of each line are displaced to those of the residual line in the vertical direction to form a staggered arrangement (see FIGS. 4 and 5).

The horizontal perforated portion 10 has a main-horizontal perforation line (upper horizontal perforation line) 10*a* and a sub-horizontal perforation line (lower horizontal perforation line) 10*b*, both of which are formed closer to and parallel to one another. The upper horizontal perforation line 10*a* is connected to the curved parts 12*b* of the cut 12, while the lower horizontal perforation line 10*b* is not connected to the curved parts 12*b*. The perforation lines each have perforations alternately positioned such that the perforations of each line are displaced to those of the residual line in the horizontal direction to form a staggered arrangement.

The horizontal perforated portion 10 has perforations (cut portions) closer to the cut 12 each having a larger size or longer size as compared with the residual perforations, each therefore having a shorter length. The length L of such longer perforations is set in the range of 15 to 35% (preferably about 25%) of the entire length of the horizontal perforated portion 10. Change in length pattern of the horizontal perforated portion 10 is made to prevent the actual tear-off line from deviating from the horizontal perforated portion 10 just after starting the tear-off of horizontal perforated portion 10, and prevent the label from being unintentionally torn off via the tension caused at the time of the application of the label 1 onto the glass bottle 2 by leaving the shorter perforations.

The label 1 has a rear surface (container contacting side) bonded with a band-shaped cut tape 13 via a pressure-sensitive adhesive or hot-melt adhesive, which tape extends across the entire length of the shrink label and also between and below the vertical perforated portions 9. The cut tape 13 is formed by a polypropylene film as a substrate, made of a polypropylene resin such as polypropylene (PP) and ethylene polypylene copolymer, and having a birefringence of 0.015 to 0.035 (preferably 0.020 to 0.030).

The birefringence of the cut tape 13 was thus limited because of the following reasons. Specifically, for the cut tape 13 having a birefringence of less than 0.015, it easily stretch, resulting in an unstabilized seal break. When having a birefringence of more than 0.03, the cut tape 13 is easily shrunk in the longitudinal direction (vertical direction) by the application of heat at the time of the shrinkage of the label 1.

Next, when forming the vertical perforated portions 9, the horizontal perforated portion 10, and the cut 12, the label 1 prior to the shrinkage is folded in flat, as illustrated in FIG. 3. At this time, the cut tape 13 is not, located on a fold line, but located closer to the fold line, and bonded via the adhesive. The vertical perforated portions 9, the horizontal perforated portion 10 and the cut 12 are then formed in the periphery of the fold line 15 by punching the flatly folded label 1 through the front side to the rear side thereof. For example, the distance between the adjacent shorter perforations of the perforated portion 10 is set to allow the shorter perforations to be arranged at a pitch of 0.5 to 2 mm, and preferably at a pitch of 0.7 mm.

The thus arranged full-shrink labeled container is formed by applying the tubular shrink label 1 around the glass bottle 2, and then heating the shrink label 1 at a temperature of about 80 to 90° C. with a steam heater (a heater of the type applying heat through vapor and steam as a result of dew condensation of the vapor) for 5 to 15 seconds, and hence causing high shrinkage of the label in the circumferential direction.

At the time of the label application, the shrink label having high shrinkability in the circumferential direction does not only cover the body 3, but also the neck 4 having a great difference in diameter with respect to the body, and even to the smallest part 4*a* in a secured manner to obtain a uniform covering state, as well as assure a constant shrinkage. Whereby, the container of the present invention can be adapted to a mass production in a stable manner.

According to the thus manufactured full-shrink labeled container, the shrink label covers the entire circumference of the glass bottle 2 to prevent the exposure of the color (brown color) of the glass bottle 2, thereby obtaining the sense of unity in appearance of the full-shrink labeled container, and hence a favorable appearance.

Since the pull ring 6 is also covered with the shrink label 1, it is hardly caught and hence deformed or damaged by something located therearound during the distribution, handling, etc., and unintentional unsealing of the container can also be avoided.

When the label 1 is to be unsealed, the pull tab 7 and the cut tape 13 are pulled upward to separate the label of the neck 4 into left and right-hand side pieces along the vertical perforated portions 9, and then the label 1 on that portion is separated along the horizontal perforated portion from the residual part around the body 3, and removed from the container.

That is, when unsealing the label 1, a right-handed person tends to unseal the label 1 towards the upper right-hand side, resulting in the force effected at the time of unsealing applied to one of the pair of vertical perforated portions 9 located at the left-hand side. In this regard, the vertical perforated portion 9 at the left-hand side is oriented towards the unsealing side (upper right-hand side), so that the label can securely be torn off. Since the pair of vertical perforated portions respectively have the outer vertical perforation lines 9*a* connected to the cut 12, the label 1 can be torn off along the outer vertical perforation lines 9*a*. In this arrangement, if it is assumed that the actual tear-off line of the label is deviated inwardly from the outer vertical perforation line, it is possible to tear the label 1 along the inner vertical perforation line 9*b*.

The cut tape 13 provided between the pair of vertical perforated portions 9 is capable of strengthening the portion to be torn off. The cut tape 13 made of the polypropylene film having a birefringence of 0.015 to 0.035 is hardly stretched and exhibits low shrinkage during the label application through the heat application. This enables easy pick-up of an end part of the cut tape 13 along with the pull tab 7, and can prevent the cut tape 13 from exhibiting excessive fragility. Moreover, the cut tape 13 having such a birefringence range is hardly torn off in the circumferential direction at the time of the tearing-off of the shrink label, which circumferential direction is a main shrinking direction of the label, with the result that the label can be securely torn off in the vertical direction along the perforated portions 9.

The large difference in outside dimension between the body 3 and the neck 4 of the container causes a great difference in the amount of label shrinkage between the portions around the body 3 and the neck 4 respectively. Consequently, the shrink label 1 after the shrinkage applied around the neck 4 becomes thicker than the portion around the body 4, and particularly increases in thickness towards the upper side thereof, since the neck is tapered down to the tip. However, the cut tape 13 provided along the vertical perforated portions 9 can obtain a sufficient strength of the portion to be torn off. Since the pull tab 7 is disposed in the lower side of the label, where it has a thinner wall, so as to unseal the label towards the upper side, the label 1 is unlikely to be cut apart at the middle portion, so that easy and smooth opening can be accomplished as compared with the arrangement that the label is unsealed from the upper side to the down side.

By cutting of the label around the neck 4 in the above manner, the pull ring 6 covered with the label 1 is exposed. This allows the user to insert his or her finger thereinto and then pull it up for the removal of the breakable cap for easy open 5 from the opening. Hence, the container can be opened.

Second Embodiment

Figure 6:
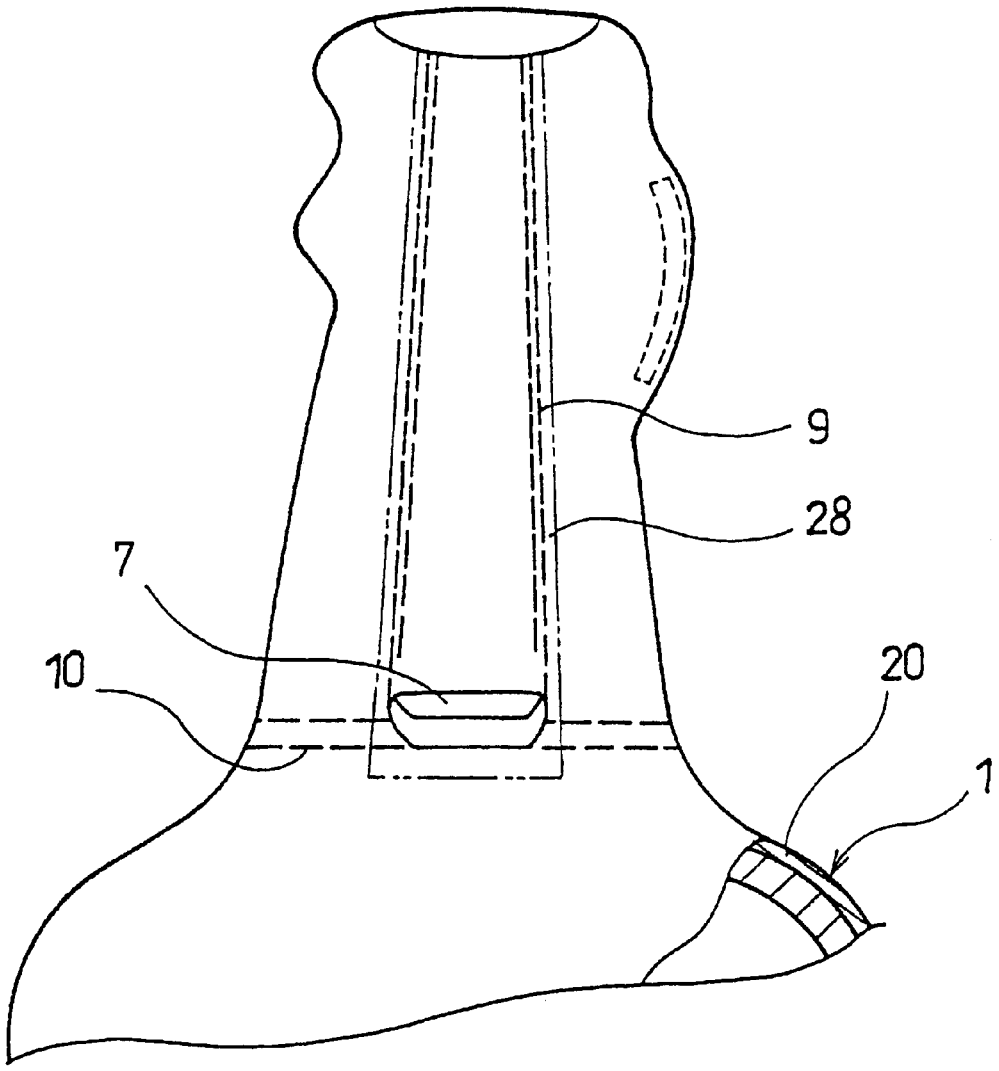
FIG. 6 is a front view with a partially cross section illustrating an essential portion of the full-shrink labeled container according to a second embodiment of the present invention.
Figure 7A:
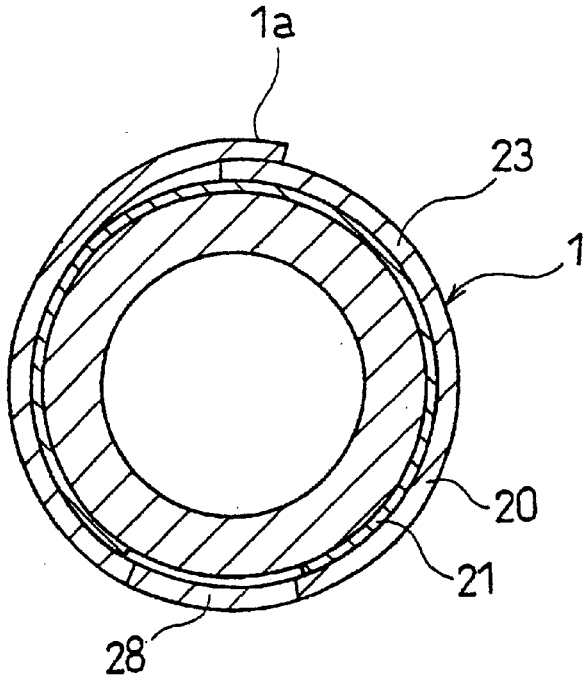
FIG. 7(*a*) is a cross-sectioned plan view of the neck of the container in FIG. 6, and FIG. 7(*b*) is a cross-sectioned plan view of an essential portion of the neck of the container in FIG. 6.
Figure 7B:
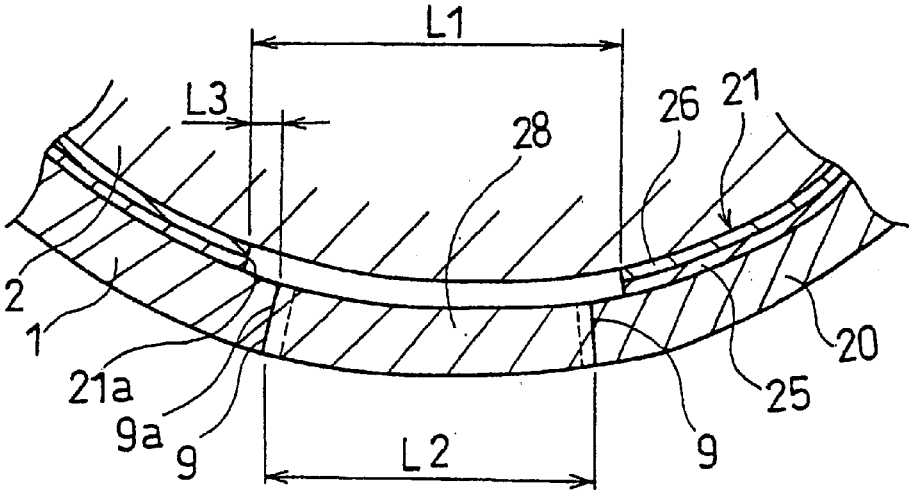

FIGS. 6 and 7 illustrate the second embodiment of the present invention. The shrink label 1 includes a label body 23 formed by a heat-shrinkable polyester film 20 and a printed layer 21 with characters, designs, etc., printed thereon, and which film 20 has opposite lateral edges overlapping one another, with the printed layer 21 inwardly facing, to form overlapping parts that are bonded together to form a tubular shape.

The printed layer 21 includes a coloring ink layer 25 with designs for the side of the film 20 and optionally colorings applied thereon, and a white printed layer (white solid printed layer) 26 formed by a white ink, which contains a pigment such as titanium oxide.

The shrink label 1 forms on a predetermined part thereof a non-print part 28 with no print applied thereon. This non-print part 28 is formed in the region of the label other than the overlapping parts 1*a*, as having a predetermined width L1, and extending in a substantially band shape from the upper end of the shrink label 1 to the shoulder of the glass bottle 2 in such a direction as to cross the main shrinkage direction of the film 20 (the dashed part in FIG. 6).

The predetermined width L1 is not necessarily kept constant. Rather, it may be set to become gradually larger towards the upper or lower side.

The pull tab 7 is disposed in a lower side of the non-print part 28 within the width L1. The perforations 8 are formed with the pull tab 7 as a starting point in the same manner as that of the first embodiment.

The distance L2 between the perforated portions 9 is set to be equal to or narrower than the width L1. Specifically, the distance L3 between an end edge 21*a* of the printed layer 21 and an outer vertical perforation line 9*a* at each side is preferably set between 0.5 to 3 mm, but it is possible to match the end edges 21*a* of the printed layer 21 with the outer vertical perforation lines 9*a*.

The full-shrink labeled container of the second embodiment is manufactured by causing the high shrinkage of the label in the circumferential direction effected by the application of the heat under the same condition as that of the first embodiment.

During the label application, the high shrinkability of the shrink label 1 in the circumferential direction enables the shrink label 1 to securely cover the neck 4 having a large diametrical difference with regard to the body 3, especially also the smallest part 4*a*, thereby obtaining a uniform container covering state.

When the shrink label 1 has been heat-shrunk, the non-print part 28 is less affected, as compared with the residual part (the part without the printed layer 21), by the printed layer 21 which becomes thicker through the heat shrinkage. As a result, original softness and stretchability of the film can be maintained. Particularly, while the heat shrinkage of the shrink label 1 results in the thicker and hardened printed layer, the outer vertical perforation lines constituting a part of the tear-off means are not affected by the printed layer because of the lack of the white printed layer 26 having a hardened ink coat, and therefore can be formed in the portions capable of maintaining, as far as possible, original softness and stretchability of the shrink label.

According to this embodiment, the large difference in outside dimension between the body 3 and the neck 4 causes a large difference in the amount of label shrinkage therebetween, with the result that the shrink label 1 after the shrinkage has the part on the neck 4 thicker than the part on the body 3. However, the outer vertical perforation lines 9*a* formed in the non-print part 28 allow the film to be hardly cut at a middle portion during the unsealing of the label by pulling the pull tab 7, even through the film has been highly shrunk. As a result, the film can be easily and securely opened, even to the upper end thereof.

Third Embodiment

Figure 8:
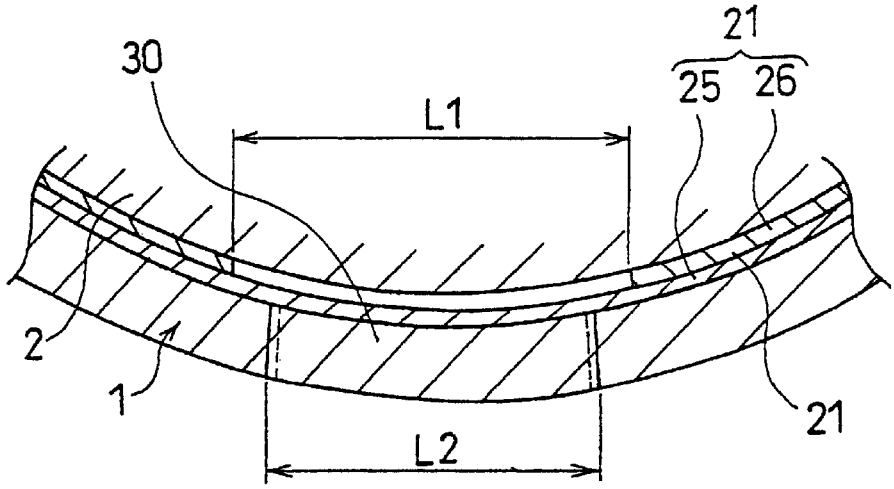
FIG. 8(*a*) is a cross-sectioned plan view illustrating an essential portion of the full-shrink labeled container according to a third embodiment of the present invention, and FIG. 8(*b*) is a cross-sectioned plan view illustrating an essential portion of the full-shrink labeled container according to a fourth embodiment of the present invention.
Figure 8:
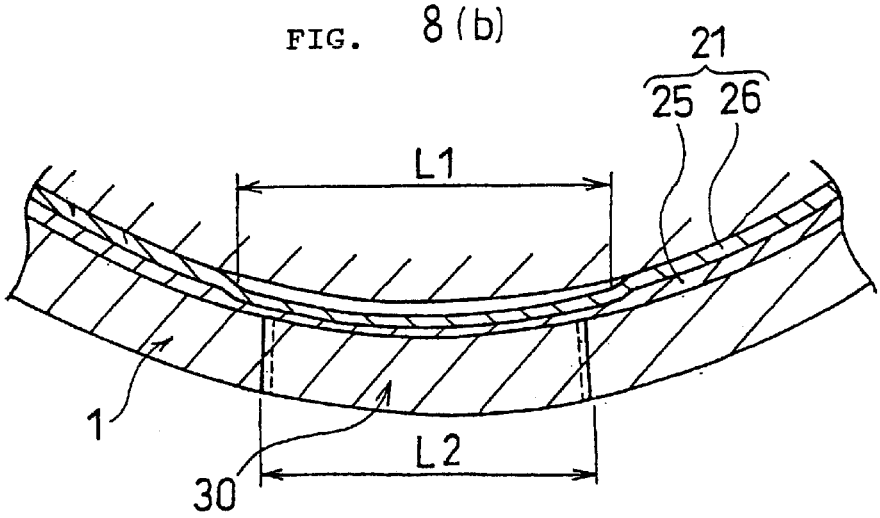

FIG. 8(*a*) illustrates the third embodiment of the present invention. Specifically, while the non-print part 28 is provided in the second embodiment, the coloring ink layer 25 in the printed layer 21 of this embodiment is provided on the entire surface of the label 1, and only the white printed layer 26 is eliminated to form a thinner part 30.

Accordingly, the elimination of the white printed layer 26, which has an influence particularly on the heat shrinking of the label, can achieve an improved openability of the label 1.

Fourth Embodiment

FIG. 8(*b*) illustrates the fourth embodiment of the present invention. Specifically, the thinner part 30 is formed by thinning the coloring ink layer 25 and the white printed layer 26, which together form the printed layer 21. Also in this arrangement, the thinner part 30 is less affected by the white printed layer 26, as compared with the residual part, thereby achieving an improved openability of the label 1.

Fifth Embodiment

Figure 9A:
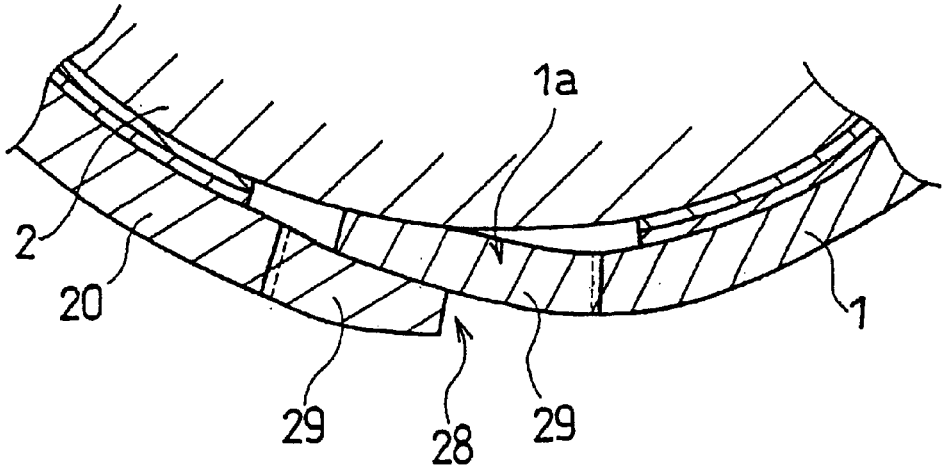
FIG. 9(*a*) is a cross-sectioned plan view illustrating an essential portion of the full-shrink labeled container according to a fifth embodiment of the present invention, and FIG. 9(*b*) is a cross-sectioned plan view illustrating an essential portion of the full-shrink labeled container according to a sixth embodiment of the present invention.
Figure 9B:
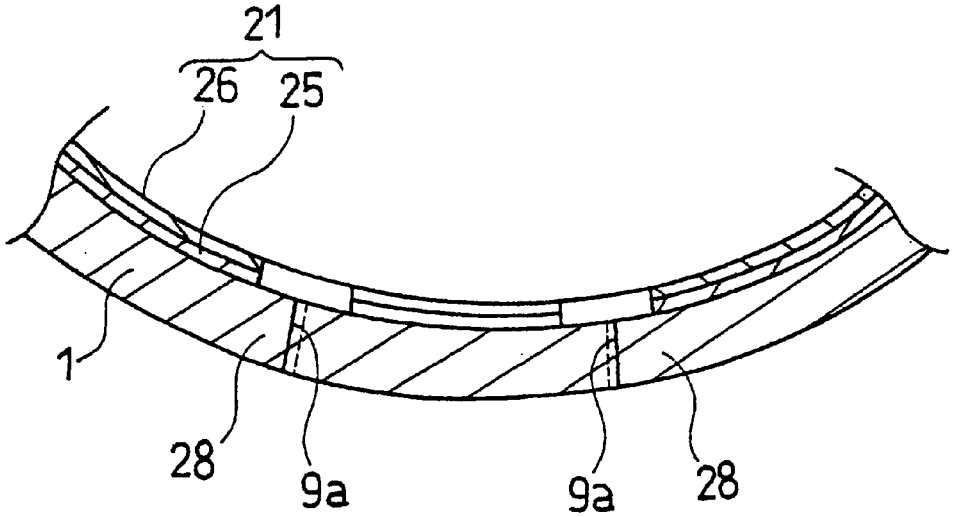

FIG. 9(*a*) illustrates the fifth embodiment of the present invention. Specifically, the film 20 has the opposite lateral edges respectively formed with clear parts carrying no prints, thereby forming the non-print, part 28. In this arrangement, the overlapping parts la of the label 1 are disposed between the pair of vertical perforated portions 9 to have a double folded part of the label, so that the label 1 can have a sufficient strength at the part to be unsealed.

Sixth Embodiment

FIG. 9(*b*) illustrates the sixth embodiment of the present invention. In this embodiment, a plurality of non-print parts 28 can be provided to correspond to the respective perforation lines 9*a*.

Seventh Embodiment

Figure 10B:
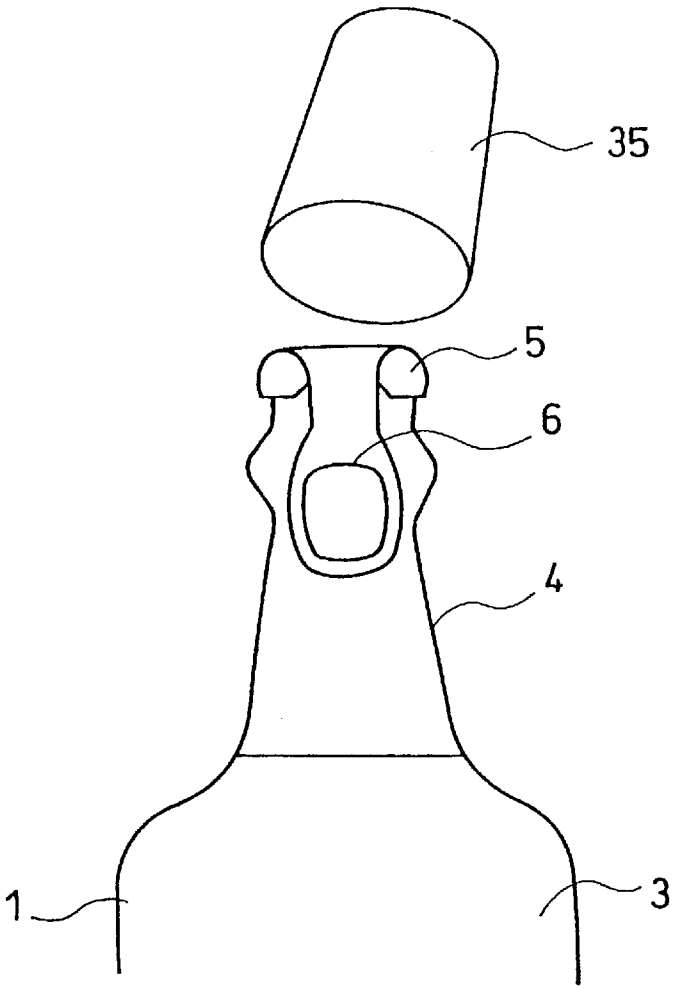
FIG. 10 illustrate a seventh embodiment of the present invention, in which FIG. 10(*a*) is a front view illustrating an essential portion of the full-shrink labeled container, and FIG. 10(*b*) is a perspective view of an essential portion of the container in an unsealed state with a cap removed therefrom.
Figure 10A:
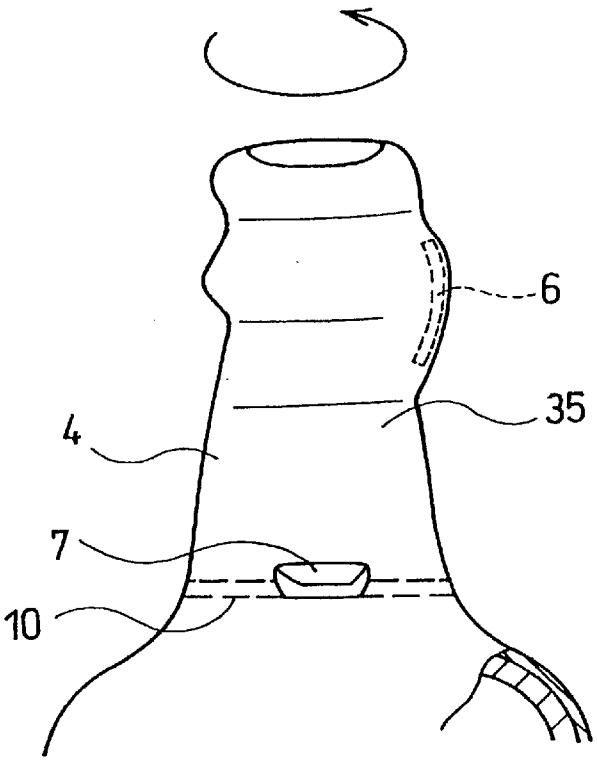

FIG. 10 illustrate the seventh embodiment of the present invention. In this embodiment, the vertical perforated portions 9 are eliminated, while only the horizontal perforated portion 10 is somewhat enlarged. This embodiment discloses the label 1 having a part (cap part) 35 covering the neck 4 of the glass bottle 2, which part is adapted to be twisted to tear the label 1 along the horizontal perforated portion 10, and remove the same. When the cap part 35 is to be removed, it can easily and securely be removed from the neck 4 by twisting the cap part 35 because the neck 4 has a tapered shape.

It is to be noted that the present invention is not necessarily limited to the aforementioned embodiments. For example, it is not necessary to limit the heat-shrinkage percentage of the shrink label 1 in the circumferential direction to 75% or more, as mentioned above. Rather, it may be varied according to the difference between the diameter B of the smallest part 4*a* and the diameter A of the body 3. For example, when the diameter B of the smallest part 4*a* is 37% of the diameter A of the body 3, the shrink label having a shrinkage percentage of 65% can be used, and a shrinkage percentage of not less than 73% enables the shrink label to uniformly shrink.

Moreover, the heat-shrinkage of the shrink label thus set to 75% or more can achieve a uniform shrinking state in more secured and stabilized manner, and hence the stabilized and low cost label application.

When the diameter B of the smallest part 4*a* is 30 to 40% of the body 3, the shrink label 1 having a heat-shrinkage percentage of not less than 73% in the circumferential direction can securely cover the container even to the smallest part 4*a*. When the body 3 does not have a uniform diameter, the diameter of the smallest part 4*a* may be set with the maximum diameter of the body as a reference.

The container may be a plastic bottle, metallic container, or the like other than the glass bottle 2. The outer shape of the container also may have a rectangular cross section. That is, when the outer shape of the container has the rectangular cross section, the relationship between the body 3, the neck 4 and the smallest part 4*a* is determined according to the respective circumferential lengths.

In the above embodiments, the perforations are employed as the tear-off means. However, the shape, arrangement, etc., of the tear-off means are not limited to those of the embodiments, and therefore are suitably modified.

According to the full-shrink labeled container of the present invention, the pull-up part for unsealing the plug is not unexposed, so that damages, etc., of the pull-up part, which may occur during the distribution, can securely be avoided. Additionally, the shrink label unitedly covers the container even to the neck, so that the sense of unity in appearance, and hence a desirable appearance can be obtained.

Moreover, the tear-off means capable of exposing the pull-up part is formed in the shrink label, so that the pull-up part can easily and securely be exposed.

According to the tubular shrink label of the present invention, it has a higher shrinkage percentage in the circumferential direction of the label, so that it can unitedly cover the body and the neck whose circumferential lengths are greatly different from each other, and a uniform shrinking state can easily be obtained in a stabilized manner.

What is claimed is:

1. A full-shrink labeled container comprising:

an opening sealed with a plug provided with a pull-up part for unsealing, a body to which a shrink label having a heat shrinkability is applied, a neck having the circumference lesser than that of the body, and said pull-up part extending from the plug, folded along the neck, and being deformable outwardly from the neck to permit the user to remove the plug, wherein the shrink label covers said container from the lower end part to the upper end part, also the pull-up part, and is formed with tear-off means capable of exposing the pull-up part, said tear-off means including a vertical tear-off means with a tear starting part from which the vertical tear-off means extends upwardly, and a horizontal tear-off means with said tear starting part from which the horizontal tear-off means extends in the circumferential direction of the container.

2. A full-shrink labeled container according to claim 1, wherein the neck is formed with a smallest part whose circumferential length is between 30 to 40% of the circumferential length of the body.

3. A full-shrink labeled container according to claim 1, wherein said vertical tearoff means is formed by a vertical perforated portion, and said horizontal tear-off means is formed by a horizontal perforated portion.

4. A full-shrink labeled container according to claim 1, wherein said shrink label is formed at a predetermined portion thereof with a non-print part on which a printed layer is not provided, and said non-print part is provided with at least a part of said tear-off means.

5. A full-shrink labeled container according to claim 1, wherein said tear-off means includes a pair of vertical perforated portions formed in the shrink label from a portion corresponding to a vicinity of the base of the neck to the upper end of the shrink label, in such a manner as to have the distance therebetween gradually decreasing towards the upper side.

6. A full-shrink labeled container comprising:

an opening sealed with a plug provided with a pull-up part for unsealing, a body to which a shrink label having a heat shrinkability is applied, a neck having the circumference less than that of the body, and said pull-up part extending from the plug, folded along the neck, and being deformable outwardly from the neck to permit the user to remove the plug, wherein the shrink label covers said container from the lower end part to the upper end part, and the pull-up part, and is formed with tear-off means capable of exposing the pull-up part, said tear-off means including a vertical tear-off means with a tear starting part from which the vertical tear-off means extends upwardly, and a horizontal tear-off means with said tear starting part from which the horizontal tear-off means extends in the circumferential direction of the container, wherein the horizontal perforated portion has perforations closer to the tear starting part each having a larger size as compared with each of the residual perforations.

7. A full-shrink labeled container according to claim 6, wherein said tear starting part is in the form of a pull tab formed by a cut in the shrink label, said vertical perforated portion includes a main-vertical perforation line connected to said cut and a sub-vertical perforation line extending parallel to said main-vertical perforation line, and the main vertical perforation line and the sub-vertical perforation line are formed in a staggered arrangement.

8. A full-shrink labeled container according to claim 6, wherein said vertical perforated portion does not extend to the upper end edge of the shrink label.

9. A full-shrink labeled container according to claim 6, wherein said tear starting part is in the form of a pull tab for unsealing the label, formed by a cut in the shrink label, said horizontal perforated portion includes a main-horizontal perforation line connected to the cut and a subhorizontal perforation line extending parallel to said main-horizontal perforation line, and the main-horizontal perforation line and the subhorizontal perforation line are formed in a staggered arrangement.

10. A full-shrink labeled container having an opening sealed with a plug provided with a pull-up part for unsealing, a body to which a shrink label having a heat shrinkability is applied, and a neck having the circumference shorter than that of the body, wherein the shrink label covers said container from the lower end part to the upper end part, also the pull-up part, and is formed with tear-off means capable of exposing the pull-up part, said tear-off means including a vertical tear-off means with a tear starting part from which the vertical tear-off means extends upwardly, and a horizontal tear-off means with said tear starting part from which the horizontal tear-off means extends in the circumferential direction of the container, wherein said vertical tear-off means includes a pair of vertical perforated portions, and the shrink label has a rear surface bonded with a cut tape having a band shape and extending between said pair of vertical perforated portions.

11. A full-shrink labeled container having an opening sealed with a plug provided with a pull-up part for unsealing, a body to which a shrink label having a heat shrinkability is applied, and a neck having the circumference shorter than that of the body, wherein the shrink label covers said container from the lower end part to the upper end part, also the pull-up part, and is formed with tear-off means capable of exposing the pull-up part, said tear-off means including a vertical tear-off means with a tear starting part from which the vertical tear-off means extends upwardly, and a horizontal tear-off means with said tear starting part from which the horizontal tear-off means extends in the circumferential direction of the container, wherein said shrink label is formed at a predetermined part thereof with a thinner part formed by thinning a printed layer, and said thinner part is provided with at least a part of said tear-off means.

12. A full-shrink labeled container having an opening sealed with a plug provided with a pull-up part for unsealing, a body to which a shrink label having a heat shrinkability is applied, and a neck having the circumference shorter than that of the body, wherein the shrink label covers said container from the lower end part to the upper end part, also the pull-up part, and is formed with tear-off means capable of exposing the pull-up part, said tear-off means including a vertical tear-off means with a tear starting part from which the vertical tear-off means extends upwardly, and a horizontal tear-off means with said tear starting part from which the horizontal tear-off means extends in the circumferential direction of the container, wherein said tear starting part is in the form of a pull tab for unsealing the label, formed by a cut in the shrink label, and said pull tab is a part to which printing is not applied.

13. A full-shrink labeled container according to claim 12, wherein said cut includes a central straight part and opposite curved parts, and the width of the straight part has a ratio of 0 to 80% with respect to the entire width of the cut of the shrink label prior to the shrinkage.

14. A full-shrink labeled container according to any one of claims 6, 10, and 11, wherein said tear starting part is in the form of a pull tab for unsealing the label, formed by a cut in the shrink label, said cut being formed in such a manner to allow said pull tab to be positioned above a base of the neck and below the pull-up part.

15. A full-shrink labeled container having an opening sealed with a plug provided with a pull-up part for unsealing, a body to which a shrink label having a heat shrinkability is applied, and a neck having the circumference shorter than that of the body, wherein the shrink label covers said container from the lower end part to the upper end part, also the pull-up part, and is formed with tear-off means capable of exposing the pull-up part, said tear-off means including a vertical tear-off means with a tear starting part from which the vertical tear-off means extends upwardly, and a horizontal tear-off means with said tear starting part from which the horizontal tear-off means extends in the circumferential direction of the container, wherein said vertical tearoff means is formed by a vertical perforated portion, and said horizontal tear-off means is formed by a horizontal perforated portion and said tear starting part is in the form of a pull tab formed by a cut in the shrink label, said vertical perforated portion includes a main-vertical perforation line connected to said cut and a sub-vertical perforation line extending parallel to said main-vertical perforation line, and the main vertical perforation line and the sub-vertical perforation line are formed in a staggered arrangement.

16. A full-shrink labeled container having an opening sealed with a plug provided with a pull-up part for unsealing, a body to which a shrink label having a heat shrinkability is applied, and a neck having the circumference shorter than that of the body, wherein the shrink label covers said container from the lower end part to the upper end part, also the pull-up part, and is formed with tear-off means capable of exposing the pull-up part, said tear-off means including a vertical tear-off means with a tear starting part from which the vertical tear-off means extends upwardly, and a horizontal tear-off means with said tear starting part from which the horizontal tear-off means extends in the circumferential direction of the container, wherein said vertical tearoff means is formed by a vertical perforated portion, and said horizontal tear-off means is formed by a horizontal perforated portion and said vertical perforated portion does not extend to the upper end edge of the shrink label.

17. A fill-shrink labeled container having an opening sealed with a plug provided with a pull-up part for unsealing, a body to which a shrink label having a heat shrinkability is applied, and a neck having the circumference shorter than that of the body, wherein the shrink label covers said container from the lower end part to the upper end part, also the pull-up part, and is formed with tear-off means capable of exposing the pull-up part, said tear-off means including a vertical tear-off means with a tear starting part from which the vertical tear-off means extends upwardly, and a horizontal tear-off means with said tear starting part from which the horizontal tear-off means extends in the circumferential direction of the container, wherein said vertical tearoff means is formed by a vertical perforated portion, and said horizontal tear-off means is formed by a horizontal perforated portion and said tear starting part is in the form of a pull tab for unsealing the label, formed by a cut in the shrink label, said horizontal perforated portion includes a main-horizontal perforation line connected to the cut and a sub-horizontal perforation line extending parallel to said main-horizontal perforation line, and the main-horizontal perforation line and the subhorizontal perforation line are formed in a staggered arrangement.

18. A full-shrink labeled container having an opening sealed with a plug provided with a pull-up part for unsealing, a body to which a shrink label having a heat shrinkability is applied, and a neck having the circumference shorter than that of the body, wherein the shrink label covers said container from the lower end part to the upper end part, also the pull-up part, and is formed with tear-off means capable of exposing the pull-up part, said tear-off means including a vertical tear-off means with a tear starting part from which the vertical tear-off means extends upwardly, and a horizontal tear-off means with said tear starting part from which the horizontal tear-off means extends in the circumferential direction of the container, wherein said shrink label is formed at a predetermined portion thereof with a non-print part on which a printed layer is not provided, and said non-print part is provided with at least a part of said tear-off means and said tear starting part is in the form of a pull tab for unsealing the label, formed by a cut in the shrink label, and said pull tab is a part to which printing is not applied.

19. A full-shrink labeled container having an opening sealed with a plug provided with a pull-up part for unsealing, a body to which a shrink label having a heat shrinkability is applied, and a neck having the circumference shorter than that of the body, wherein the shrink label covers said container from the lower end part to the upper end part, also the pull-up part, and is formed with tear-off means capable of exposing the pull-up part, said tear-off means including a vertical tear-off means with a tear starting part from which the vertical tear-off means extends upwardly, and a horizontal tear-off means with said tear starting part from which the horizontal tear-off means extends in the circumferential direction of the container, wherein said tear starting part is in the form of a pull tab for unsealing the label, formed by a cut in the shrink label, said cut being formed in such a manner to allow said pull tab to be positioned above a base of the neck and below the pull-up part.

20. A full-shrink labeled container having an opening sealed with a plug provided with a pull-up part for unsealing, a body to which a shrink label having a heat shrinkability is applied, and a neck having the circumference shorter than that of the body, wherein the shrink label covers said container from the lower end part to the upper end part, also the pull-up part, and is formed with tear-off means capable of exposing the pull-up part, said tear-off means including a vertical tear-off means with a tear starting part from which the vertical tear-off means extends upwardly, and a horizontal tear-off means with said tear starting part from which the horizontal tear-off means extends in the circumferential direction of the container, wherein the neck is formed with a smallest part whose circumferential length is between 30 to 40% of the circumferential length of the body and said tear starting part is in the form of a pull tab for unsealing the label, formed by a cut in the shrink label, said cut being formed in such a manner to allow said pull tab to be positioned above a base of the neck and below the pull-up part.

21. A full-shrink labeled container having an opening sealed with a plug provided with a pull-up part for unsealing, a body to which a shrink label having a heat shrinkability is applied, and a neck having the circumference shorter than that of the body, wherein the shrink label covers said container from the lower end part to the upper end part, also the pull-up part, and is formed with tear-off means capable of exposing the pull-up part, said tear-off means including a vertical tear-off means with a tear starting part from which the vertical tear-off means extends upwardly, and a horizontal tear-off means with said tear starting part from which the horizontal tear-off means extends in the circumferential direction of the container, wherein said vertical tearoff means is formed by a vertical perforated portion, and said horizontal tear-off means is formed by a horizontal perforated portion and said tear starting part is in the form of a pull tab for unsealing the label, formed by a cut in the shrink label, said cut being formed in such a manner to allow said pull tab to be positioned above a base of the neck and below the pull-up part.

22. A full-shrink labeled container having an opening sealed with a plug provided with a pull-up part for unsealing, a body to which a shrink label having a heat shrinkability is applied, and a neck having the circumference shorter than that of the body, wherein the shrink label covers said container from the lower end part to the upper end part, also the pull-up part, and is formed with tear-off means capable of exposing the pull-up part, said tear-off means including a vertical tear-off means with a tear starting part from which the vertical tear-off means extends upwardly, and a horizontal tear-off means with said tear starting part from which the horizontal tear-off means extends in the circumferential direction of the container, wherein said shrink label is formed at a predetermined portion thereof with a non-print part on which a printed layer is not provided, and said non-print part is provided with at least a part of said tear-off means and said tear starting part is in the form of a pull tab for unsealing the label, formed by a cut in the shrink label, said cut being formed in such a manner to allow said pull tab to be positioned above a base of the neck and below the pull-up part.

* * * * *